US010401095B2

(12) United States Patent
Yamamoto et al.

(10) Patent No.: US 10,401,095 B2
(45) Date of Patent: Sep. 3, 2019

(54) HEAT EXCHANGER

(71) Applicant: DENSO CORPORATION, Kariya, Aichi-pref. (JP)

(72) Inventors: Michiyasu Yamamoto, Chiryu (JP); Takahiro Uno, Kariya (JP); Kazutaka Suzuki, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 88 days.

(21) Appl. No.: 14/435,371

(22) PCT Filed: Oct. 2, 2013

(86) PCT No.: PCT/JP2013/005861

§ 371 (c)(1),
(2) Date: Apr. 13, 2015

(87) PCT Pub. No.: WO2014/061216

PCT Pub. Date: Apr. 24, 2014

(65) Prior Publication Data

US 2015/0233652 A1 Aug. 20, 2015

(30) Foreign Application Priority Data

Oct. 17, 2012 (JP) ..... 2012-229730

(51) Int. Cl.
*F28F 9/02* (2006.01)
*F28F 9/04* (2006.01)
(Continued)

(52) U.S. Cl.
CPC ..... *F28F 9/02* (2013.01); *F28F 9/0226* (2013.01); *F28F 9/04* (2013.01); *F28F 9/26* (2013.01);
(Continued)

(58) Field of Classification Search
CPC .... F28F 9/0226; F28F 9/04; F28F 2009/0297; F28F 9/26
See application file for complete search history.

(56) References Cited

U.S. PATENT DOCUMENTS 3,995,689 A * 12/1976 Cates ..... F28B 1/06 165/166
5,845,705 A * 12/1998 Vinh ..... F28D 1/05391 165/173
(Continued)

FOREIGN PATENT DOCUMENTS

DE 10335344 A1 3/2005
JP S5361862 U 5/1978
(Continued)

OTHER PUBLICATIONS

Office Action dated Sep. 29, 2015 in corresponding Japanese Application No. 2012-229730.
(Continued)

*Primary Examiner* — Keith M Raymond
*Assistant Examiner* — Nael N Babaa
(74) *Attorney, Agent, or Firm* — Harness, Dickey & Pierce, P.L.C.

(57) ABSTRACT

A heat exchanger includes tubes and a header tank. The tubes are arranged in parallel with each other, and fluid flows in the tubes. The header tank is disposed at end portions of the tubes in a longitudinal direction of the tubes and extends in a direction in which the tubes are arranged in parallel with each other to communicate with the tubes. The header tank includes a core plate, a resin tank main body part, and a resiliently-deformable sealing member. The tubes are joined to the core plate. The tank main body part is fixed to the core plate. The core plate includes a receiving part at which the sealing member is disposed. The tank main body part is fixed to the core plate with the sealing member clamped between
(Continued)

an end part of the tank main body part on the core plate-side and the receiving part. The receiving part is disposed on a farther side from the tubes in the longitudinal direction of the tubes than the end portions of the tubes in the longitudinal direction of the tubes.

8 Claims, 10 Drawing Sheets

(51) Int. Cl.

| | |
|---|---|
| ***F28F 9/26*** | (2006.01) |
| *F28F 21/06* | (2006.01) |
| *F28D 1/053* | (2006.01) |
| *F28D 21/00* | (2006.01) |

(52) U.S. Cl.
CPC .. *F28D 1/05366* (2013.01); *F28D 2021/0094* (2013.01); *F28F 21/06* (2013.01); *F28F 2009/0297* (2013.01); *F28F 2275/122* (2013.01)

(56) References Cited

U.S. PATENT DOCUMENTS

| | | | | |
|---|---|---|---|---|
| 6,644,392 | B2 | 11/2003 | Kalbascher | |
| 7,341,098 | B2 | 3/2008 | Brost et al. | |
| 2003/0006028 | A1 | 1/2003 | Kalbacher | |
| 2003/0037743 | A1 | 2/2003 | Salameh | |
| 2005/0039894 | A1 | 2/2005 | Brost et al. | |
| 2008/0121386 | A1 | 5/2008 | Hakamata et al. | |
| 2009/0255657 | A1 | 10/2009 | Hakamata et al. | |
| 2011/0168372 | A1* | 7/2011 | Takahashi | F28D 1/0443 165/173 |
| 2013/0146267 | A1* | 6/2013 | Garret | F28D 7/1684 165/175 |

FOREIGN PATENT DOCUMENTS

| | | | | | |
|---|---|---|---|---|---|
| JP | S59103087 | U | | 7/1984 | |
| JP | S59191093 | U | | 7/1984 | |
| JP | H04268199 | A | | 9/1992 | |
| JP | H0875388 | A | | 3/1996 | |
| JP | H10132485 | A | | 5/1998 | |
| JP | 2008116079 | A | | 5/2008 | |
| JP | 2008261550 | A | | 10/2008 | |
| JP | 2009257657 | A | | 11/2009 | |
| JP | 2011099631 | A | | 5/2011 | |
| JP | 2012092674 | A | | 5/2012 | |
| JP | 2012-117791 | | | 6/2012 | |
| KR | 2008071867 | A | * | 1/2007 | F28F 9/04 |

OTHER PUBLICATIONS

Office Action dated Jul. 7, 2015 in corresponding Japanese Application No. 2012-229730.

International Search Report and Written Opinion (in Japanese with English Translation) for PCT/JP2013/005861, date Dec. 24, 2013; ISA/JP.

Information statement, presentation of publications and the like, submission of information dated Jan. 26, 2015 in corresponding JP Application No. 2012-229730.

* cited by examiner

HEAT EXCHANGER

CROSS REFERENCE TO RELATED APPLICATIONS

This application is a U.S. National Phase Application under 35 U.S.C. 371 of International Application No. PCT/JP2013/005861 filed on Oct. 2, 2013 and published in Japanese as WO 2014/061216 A1 on Apr. 24, 2014. This application is based on and claims the benefit of priority from Japanese Patent Application No. 2012-229730 filed on Oct. 17, 2012. The entire disclosures of all of the above applications are incorporated herein by reference.

TECHNICAL FIELD

The present disclosure relates to a heat exchanger, and is effective for a heat exchanger for a vehicle that is disposed in the vehicle.

BACKGROUND ART

Conventionally, a header tank of a heat exchanger such as a radiator is configured by integrating a metal core plate to which each tube is joined, and a resin tank main body part that defines an inner-tank space. A packing (sealing member) made of an elastic member such as rubber is disposed between the core plate and the tank main body part, and the core plate and the tank main body part are sealed by compression of this packing at the core plate and the tank main body part.

In a heat exchanger described in Patent Document 1, a core plate includes a tube joint surface where a tube is joined, and a groove part formed at an outer peripheral edge part of the tube joint surface. An end portion of a tank main body part on the core-plate side is inserted in the groove part of the core plate. The tank main body part is fixed to the core plate with a packing clamped between the groove part of the core plate and the end portion of the tank main body part.

PRIOR ART DOCUMENT

Patent Document

Patent Document 1: JP2009-257657A

In the heat exchanger described in the above Patent Document 1, because the groove part is formed at the core plate, length of the core plate in a flow direction of external fluid (hereinafter also referred to as a width direction size) becomes larger by this groove part. Accordingly, due to the groove part of the core plate, a space where nothing is arranged when disposed in a vehicle is created so that a dead space is formed.

SUMMARY OF INVENTION

The present disclosure addresses the above issues. Thus, it is an objective of the present disclosure to make small a dead space of installation in a heat exchanger disposed in a vehicle or the like.

To achieve the objective of the present disclosure, in one aspect of the present disclosure, a receiving part at which a resiliently deformable sealing member is disposed is provided for a core plate. The tank main body part is fixed to the core plate with a sealing member clamped between an end portion of a tank main body part on the core-plate side, and the receiving part. The receiving part is disposed on a farther side from each tube in the longitudinal direction of each tube than an end portion of each tube in its longitudinal direction.

Accordingly, by providing the receiving part for the core plate and by disposing the receiving part on a farther side from each tube in the longitudinal direction of each tube than the end portion of each tube in its longitudinal direction, there is eliminated a need to provide a groove part for inserting the end portion of the tank main body part into the core plate. Thus, the length of the core plate in a flow direction of external fluid can be shortened. As a result, a dead space of installation can be reduced.

In addition, "the receiving part at which the sealing member is disposed" means not only that the sealing member is disposed directly at the receiving part but also that the sealing member is disposed at the receiving part via another member.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Figure 1:
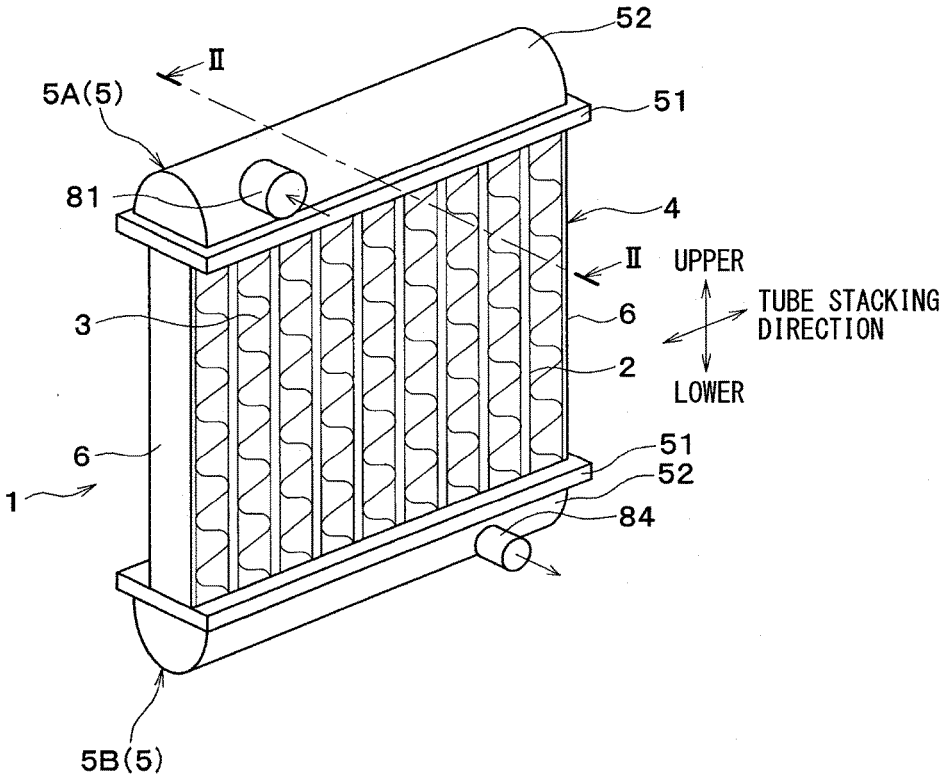
FIG. 1 is a perspective view illustrating a radiator in accordance with a first embodiment.

Embodiments will be described below in reference to the drawings. For the same or equivalent component in the following embodiments, its corresponding reference numeral is used in the drawings.

First Embodiment

A first embodiment will be described below with reference to FIGS. 1 and 2. The present embodiment illustrates a case of application of a heat exchanger to a radiator for an automobile that performs heat exchange between engine coolant and air to cool the engine coolant.

Figure 2:
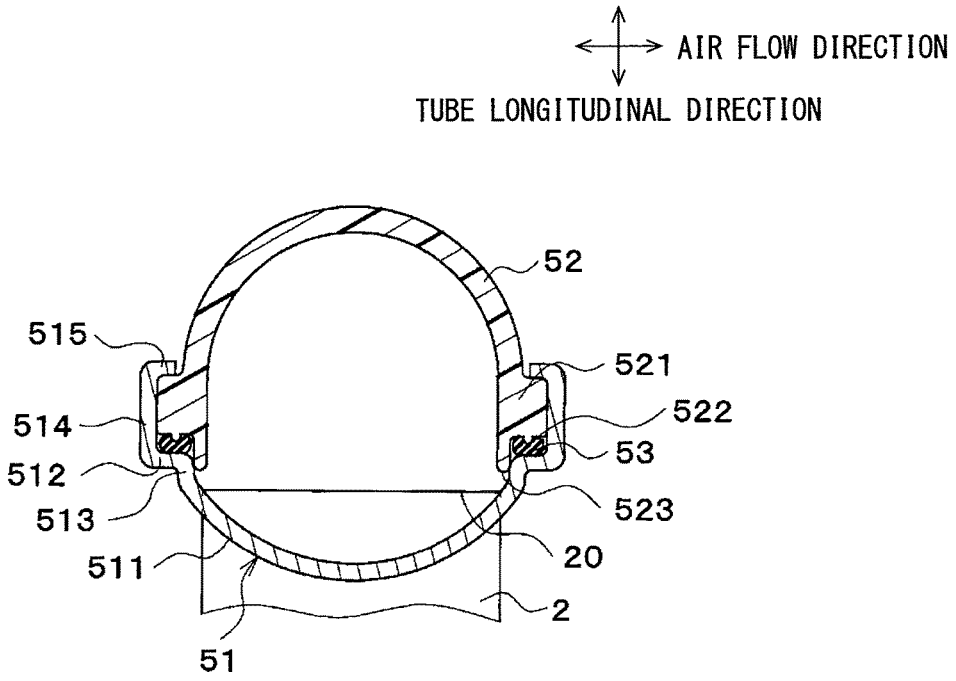
FIG. 2 is a cross-sectional view taken along a line II-II in FIG. 1.

As illustrated in FIG. 1, a radiator 1 of the present embodiment includes a core part 4 having tubes 2 and fins 3, and a pair of header tanks 5 attached and arranged at both end portions of the core part 4.

The tube 2 is a pipe through which fluid (engine coolant in the present embodiment) flows. This tube 2 is formed into a flat shape such that an air flow direction accords with its longer diameter direction. Furthermore, more than one tube 2 are arranged in the horizontal direction parallel to each other so that their longitudinal direction accords with the vertical direction. The fins 3 are formed in a corrugated shape, and are joined to the flat surfaces on both sides of the tube 2, and this fin 3 increases a heat-transfer area to the air, thereby promoting heat exchange between the engine coolant flowing in the tube 2 and the air.

At both end portions of the tube 2 in its longitudinal direction (hereinafter referred to as a tube longitudinal direction), the header tank 5 extends in a direction perpendicular to the tube longitudinal direction to communicate with the tubes 2. In the present embodiment, the header tank 5 is disposed at upper and lower ends of the tubes 2 and extends in the horizontal direction to communicate with the tubes 2. This header tank 5 includes a core plate 51 into which the tubes 2 are inserted and joined, and a tank main body part 52 that constitutes a tank space together with the core plate 51.

Additionally, side plates 6 for reinforcement of the core part 4 are provided at both end portions of the core part 4 in a stacking direction of the tubes 2 (hereinafter referred to as a tube stacking direction). The side plate 6 extends parallel to the tube longitudinal direction and its both end parts are connected to the header tanks 5.

A detailed configuration of the header tank 5 will be described. As illustrated in FIG. 2, the header tank 5 includes the core plate 51 into which the tubes 2 and the side plates 6 are inserted and joined, the tank main body part 52 that constitutes an inner-tank space which is a space in the header tank 5 together with the core plate 51, and a packing 53 serving as a sealing member that seals a clearance between the core plate 51 and the tank main body part 52. In the present embodiment, the core plate 51 is made of aluminum alloy, and the tank main body part 52 is made of resin such as glass-reinforced polyamide reinforced by glass fiber.

By plastically-deforming a projection piece (pawl part) 515 of the core plate 51 to be described hereinafter to be pressed on the tank main body part 52 with the packing 53 clamped between the core plate 51 and the tank main body part 52, the tank main body part 52 is crimped and fixed to the core plate 51. The packing 53 of the present embodiment is configured from elastically-deformable rubber (in the present example, ethylene propylene diene rubber (EPDM)).

The core plate 51 includes a tube joint surface 511 to which the tube 2 is joined. At the tube joint surface 511, many tube insertion holes (not shown) into which the tubes 2 are respectively inserted and brazed are formed along the tube stacking direction. In addition, at the tube joint surface 511, one side plate insertion hole (not shown) into which the side plate 6 is inserted and brazed is formed on each of both end sides of the tube joint surface 511 in the tube stacking direction. The tube joint surface 511 is curved in an arc-like manner to swell toward the core part 4-side (opposite side from the tank main body part 52) in the tube longitudinal direction.

A receiving part 512 where the packing 53 is disposed is provided at the outer peripheral edge part of the core plate 51, i.e., around the tube joint surface 511. More specifically, the core plate 51 includes a first wall part 513 that is bent from an outer peripheral portion of the tube joint surface 511 toward a farther side from the tube 2 in the tube longitudinal direction to extend in the tube longitudinal direction, the receiving part 512 that is bent outward of the tank from the first wall part 513 generally perpendicularly to extend in a direction perpendicular to the tube longitudinal direction, and a second wall part 514 that is bent from the receiving part 512 generally perpendicularly toward a farther side from the tube 2 in the tube longitudinal direction to extend in the tube longitudinal direction. Additionally, many projection pieces 515 are formed at an end portion of the second wall part 514.

The receiving part 512 is disposed on a farther side from the tube 2 than a longitudinal end 20 of the tube 2 in the tube longitudinal direction (on a farther side from the core part 4). An end part of the tank main body part 52 on the core plate 51-side (hereinafter referred to as a skirt part 521) is disposed at the receiving part 512 via the packing 53. Thus, the tank main body part 52 is fixed to the core plate 51 with the packing 53 clamped between the skirt part 521 and the receiving part 512.

A surface of the skirt part 521 of the tank main body part 52 on the core plate 51-side (hereinafter referred to as a tank-side sealing surface 522) is formed annularly to surround the inner-tank space. When viewed from the core part 4-side (lower side on a plane of paper), the packing 53 is formed annularly to surround the inner-tank space, i.e., to surround the entire periphery of the skirt part 521.

An inner projecting part 523 that projects toward the tube joint surface 511 of the core plate 51 is formed on an inner peripheral side of the tank-side sealing surface 522 (tank inward side). In the present embodiment, the inner projecting part 523 and an inner peripheral end portion of the receiving part 512 of the core plate 51 are in contact with each other. By providing this inner projecting part 523, displacement of the packing 53 toward the inside of the tank is limited.

As described above, the receiving part 512 where the skirt part 521 of the tank main body part 52 and the packing 53 are arranged is provided for the core plate 51, and the receiving part 512 is disposed on a farther side from the tube 2 than the longitudinal end 20 of the tube in the tube longitudinal direction. Accordingly, the tank main body part 52 can be fixed to the core plate 51 without the core plate 51 including a groove part in which the skirt part 521 of the tank main body part 52 is inserted. As a result, the length of the core plate 51 in the air flow direction can be shortened, and a dead space of installation can thereby be made small.

Moreover, by shortening the length of the core plate 51 in the air flow direction, the header tank 5 can decrease in size. If the header tank 5 is downsized, the volume of coolant water in the header tank 5 can also be reduced. Accordingly, the weight of the radiator 1 can be reduced when the radiator 1 is disposed in a vehicle. In addition, reduction of material costs can be achieved because of the downsized header tank 5.

In the present embodiment, the tube joint surface 511 is curved in an arc-like manner to swell toward the core part 4 in the tube longitudinal direction. Consequently, a thermal stress produced at an attachment part between the tube 2 and the core plate 51 can be dispersed. As a result, damage to the attachment part between the tube 2 and the core plate 51 due to the thermal stress can be inhibited.

Second Embodiment

Figure 3:
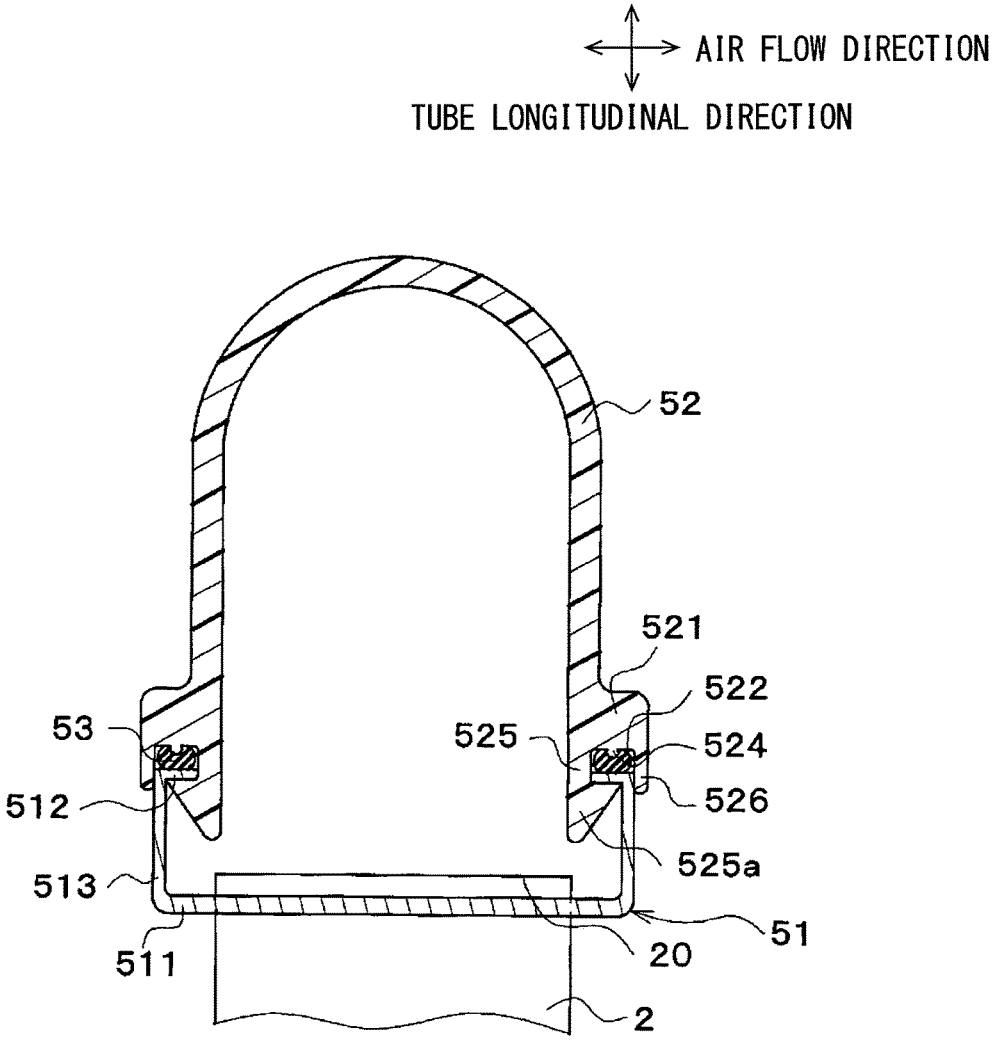
FIG. 3 is a cross-sectional view illustrating a header tank of a radiator in accordance with a second embodiment.

A second embodiment will be described with reference to FIG. 3. This second embodiment differs in shapes of the receiving part 512 and the skirt part 521 from the above-described first embodiment. FIG. 3 corresponds to FIG. 2 in the above first embodiment.

As illustrated in FIG. 3, a tube joint surface 511 of a core plate 51 of the present embodiment extends in a direction perpendicular to the tube longitudinal direction, and is not curved in an arc-like manner. The core plate 51 includes a wall part 513 that is bent generally perpendicularly from an outer peripheral portion of the tube joint surface 511 toward a far side from a tube 2 in the tube longitudinal direction to extend in the tube longitudinal direction, and a receiving part 512 that is bent generally perpendicularly from the wall part 513 toward the tank-inward side to extend in a direction perpendicular to the tube longitudinal direction.

A projection 524 that projects toward a packing 53 is formed on a tank-side sealing surface 522 of a tank main body part 52. This projection 524 stabilizes a position of the packing 53 by pressing the packing 53 to compress the packing 53 by its elastic deformation, and ensures a proper compression ratio.

A snap-fit part 525 projecting toward a longitudinal end 20 of the tube 2 is provided inward of the tank-side sealing surface 522 (on a tank inward side). The snap-fit part 525 functions as a pawl-shaped engagement part. By attaching the tank main body part 52 to the core plate 51 from a far side from the tube 2 in the tube longitudinal direction, a pawl part 525*a* formed at the end of the snap-fit part 525 is engaged with the receiving part 512 described above. The pawl part 525*a* is in contact with a surface of the receiving part 512 on a core part 4-side (lower side on a plane of paper).

More specifically, when attaching the tank main body part 52 to the core plate 51 from a far side from the tube 2 in the tube longitudinal direction, the pawl part 525*a* is brought into contact with an inner peripheral edge portion of the receiving part 512. Accordingly, by its resilient deformation, the snap-fit part 525 is bent inward of the tank with its connecting portion to the tank-side sealing surface 522 serving as a supporting point. Then, after the pawl part 525*a* has been displaced to a position closer to the tube 2 than the receiving part 512 in the tube longitudinal direction, when the snap-fit part 525 recovers its original shape, the snap-fit part 525 can be put into such a non-clearance state that a surface of the pawl part 525*a* on a far side from the tube 2 in the tube longitudinal direction is generally in contact with a surface of the receiving part 512 on a closer side to the tube 2 in the tube longitudinal direction.

An outer projecting part 526 projecting toward a close side to the tube 2 in the tube longitudinal direction is formed on an outer peripheral side of the tank-side sealing surface 522 (on a tank outward side). In the present embodiment, the outer projecting part 526 and the wall part 513 of the core plate 51 are in contact with each other. By providing this outer projecting part 526, movement of the packing 53 outward of the tank is restricted.

In the present embodiment, only by attaching the tank main body part 52 to the core plate 51 from a far side from the tube 2 in the tube longitudinal direction, the tank main body part 52 can be easily fixed to the core plate 51.

Third Embodiment

A third embodiment will be described in reference to FIG. 4. This third embodiment differs in shape of the skirt part 521 of the tank main body part 52 from the above-described second embodiment.

Figure 4:
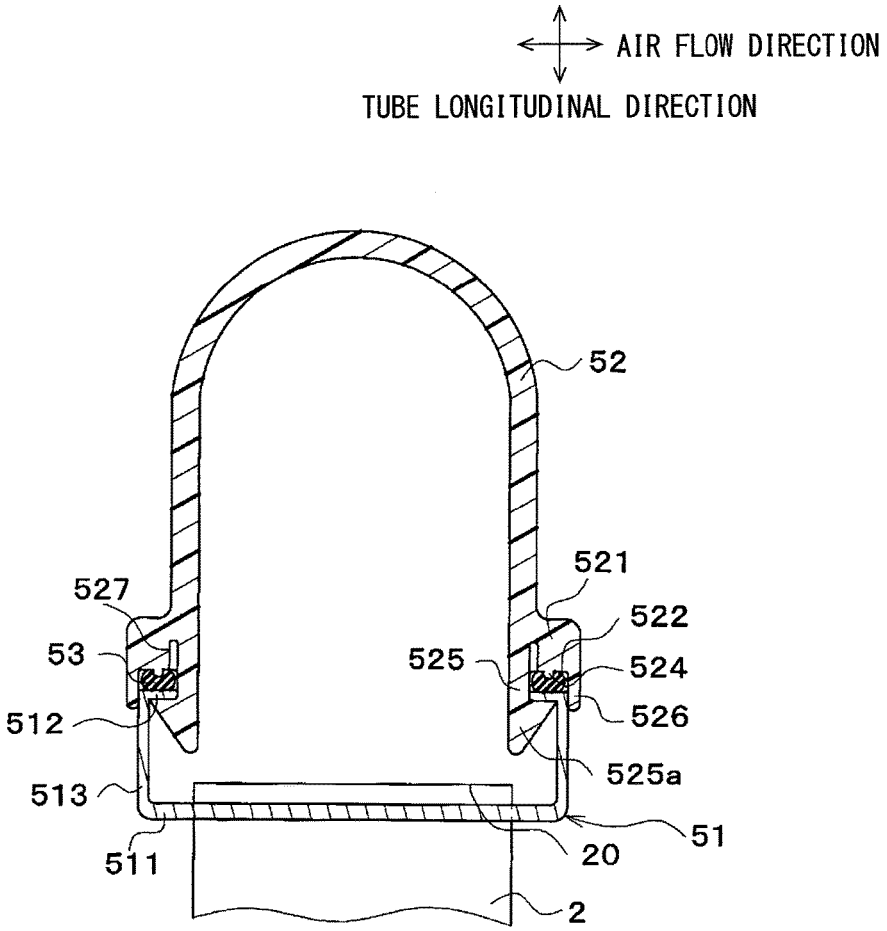
FIG. 4 is a cross-sectional view illustrating a header tank of a radiator in accordance with a third embodiment.

As illustrated in FIG. 4, a skirt part 521 includes a slit 527 extending from a connecting portion to a snap-fit part 525 toward a far side from a tube 2 in the tube longitudinal direction. The snap-fit part 525 is easily resiliently-deformed by this slit 527. Accordingly, a tank main body part 52 can easily be attached to a core plate 51.

Fourth Embodiment

A fourth embodiment will be described with reference to FIG. 5. This fourth embodiment differs in shape of the header tank 5 from the above-described second embodiment.

Figure 5:
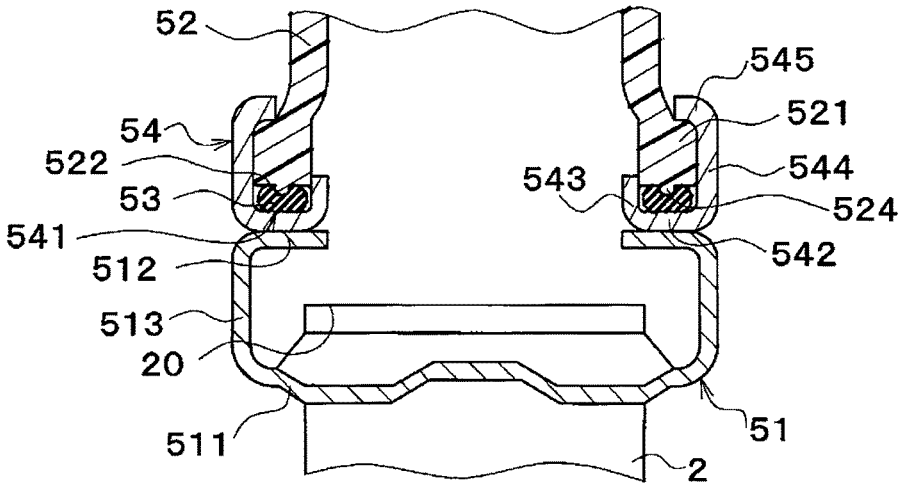
FIG. 5 is a cross-sectional view illustrating a header tank of a radiator in accordance with a fourth embodiment.

As illustrated in FIG. 5, in the present embodiment, a tank fixation plate 54 made of metal (e.g., made of aluminum alloy) is disposed between a core plate 51 and a tank main body part 52. The tank fixation plate 54 includes a groove portion 541, in which a skirt part 521 of the tank main body part 52 and a packing 53 are inserted, along the entire periphery of the tank fixation plate 54. The tank fixation plate 54 is joined to a receiving part 512 by brazing.

More specifically, the groove portion 541 of the tank fixation plate 54 is formed by three surfaces. That is to say, the groove portion 541 is formed by a wall surface of a seal wall part 542 that extends in a direction perpendicular to the tube longitudinal direction; a wall surface of an inner wall part 543 that is bent generally perpendicularly from an inner peripheral portion of the seal wall part 542 toward a far side from a core part 4 to extend in the tube longitudinal direction; and a wall surface of an outer wall part 544 that is bent generally perpendicularly from an outer peripheral portion of the seal wall part 542 toward a far side from the core part 4 to extend in the tube longitudinal direction. Many projection pieces 545 are formed at an end portion of the outer wall part 544.

A surface of the seal wall part 542 on a close side to a tube 2 in the tube longitudinal direction is joined to the receiving part 512, and the packing 53 is disposed on a surface of the seal wall part 542 on a far side from the tube 2 in the tube longitudinal direction. In the present embodiment, the outer wall part 544 of the tank fixation plate 54 and a first wall part 513 of the core plate 51 are arranged on the same plane.

A method of making the header tank 5 of a radiator 1 of the present embodiment will be described. First, the tank fixation plate 54 is fixed to the core plate 51 by joining together the receiving part 512 and the seal wall part 542 through brazing. Then, the packing 53 and the skirt part 521 of the tank main body part 52 are inserted into the groove portion 541 of the tank fixation plate 54. Subsequently, with the packing 53 clamped between the tank fixation plate 54 and the tank main body part 52, the projection piece 545 of the tank fixation plate 54 is plastically-deformed to be pressed on the tank main body part 52, so that the tank main body part 52 is crimped and fixed to the tank fixation plate 54.

In the present embodiment, the tank fixation plate 54 for fixing the skirt part 521 of the tank main body part 52 and the packing 53 is joined to the receiving part 512 of the core plate 51. Thus, the skirt part 521 of the tank main body part 52 and the packing 53 are arranged on the receiving part 512 via the tank fixation plate 54. This receiving part 512 is disposed on a farther side from the tube 2 than a longitudinal end 20 of the tube in the tube longitudinal direction. Accordingly, the groove portion 541 is provided for the tank fixation plate 54, whereas there is avoided a need to provide a groove portion in which to insert the skirt part 521 of the tank main body part 52 for the core plate 51. As a result, the length of the core plate 51 in the air flow direction can be shortened. Therefore, effects similar to the above-described first embodiment can be produced.

Fifth Embodiment

A fifth embodiment will be described with reference to FIGS. 6 and 7. This fifth embodiment is different from the above fourth embodiment in structure for fixing the tank main body part 52 to the tank fixation plate 54.

Figure 6:
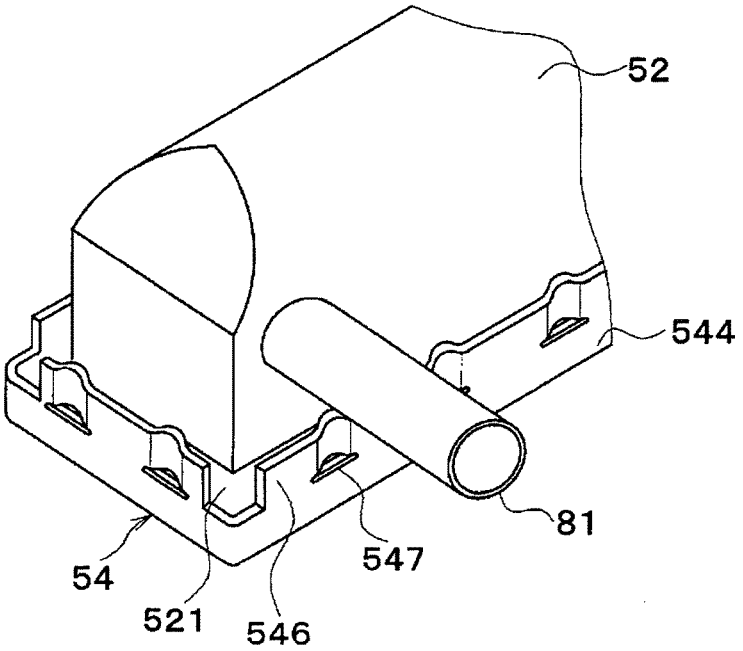
FIG. 6 is a perspective view illustrating a tank main body part and a tank fixation plate of a radiator in accordance with a fifth embodiment.
Figure 7:
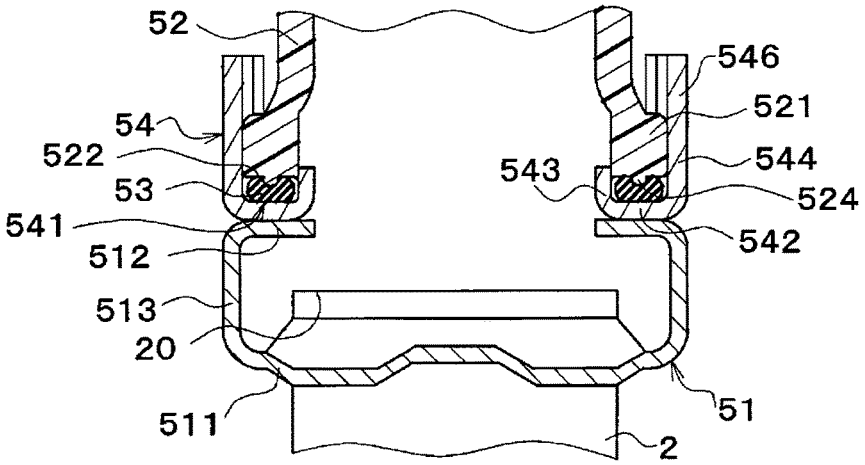
FIG. 7 is a cross-sectional view illustrating a header tank of the radiator of the fifth embodiment.

As illustrated in FIGS. 6 and 7, a tank fixation plate 54 includes a fixation wall part 546 that is connected to an outer wall part 544 and extends in the tube longitudinal direction. The fixation wall part 546 extends to a farther side from a tube 2 than a skirt part 521 in the tube longitudinal direction. Notches 547 extending in a direction perpendicular to the tube longitudinal direction are formed between the outer wall part 544 and the fixation wall part 546 of the tank fixation plate 54.

In the present embodiment, a part of the fixation wall part 546 that corresponds to the notch 547 is plastically-deformed to be pressed on the tank main body part 52, with a packing 53 clamped between a groove portion 541 of the tank fixation plate 54 and the skirt part 521 of a tank main body part 52. Accordingly, the tank main body part 52 is fixed to the tank fixation plate 54. In the present embodiment, effects similar to the above-described fourth embodiment can be produced.

Sixth Embodiment

A sixth embodiment will be described in reference to FIG. 8. This sixth embodiment is different from the above fifth embodiment in shapes of the core plate 51 and the tank fixation plate 54.

Figure 8:
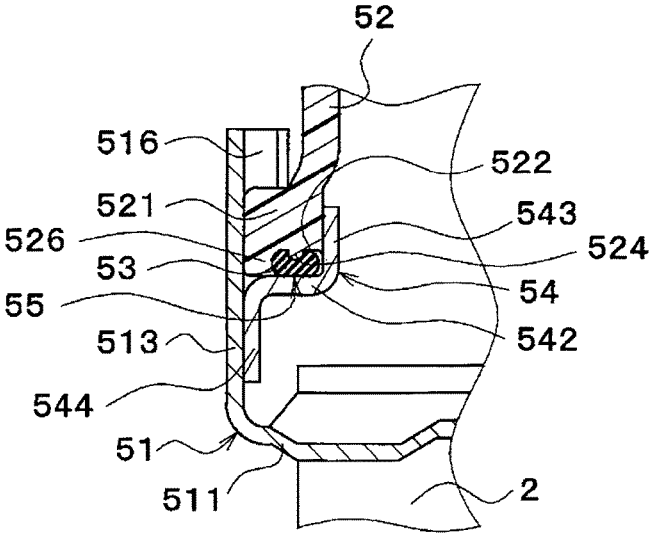
FIG. 8 is a cross-sectional view illustrating a header tank of a radiator in accordance with a sixth embodiment.

As illustrated in FIG. 8, a fixation wall part 516 extending in the tube longitudinal direction is connected to a first wall part 513 of a core plate 51. This fixation wall part 516 extends to a far side of a skirt part 521 from a tube 2 in the tube longitudinal direction.

An outer wall part 544 of a tank fixation plate 54 of the present embodiment is bent generally perpendicularly from an outer peripheral portion of a seal wall part 542 toward a close side to a core part 4 to extend in the tube longitudinal direction. The outer wall part 544 is joined on a tank-inward surface of the first wall part 513 by brazing.

Accordingly, in the present embodiment, a groove portion 55, in which the skirt part 521 of a tank main body part 52 and a packing 53 are inserted, is formed by three surfaces: a wall surface of the first wall part 513 of the core plate 51, a wall surface of the seal wall part 542 of the tank fixation plate 54, and a wall surface of an inner wall part 543.

An outer projecting part 526 projecting toward a close side to the tube 2 in the tube longitudinal direction is formed on an outer peripheral side of a tank-side sealing surface 522. In the present embodiment, the outer projecting part 526 and the first wall part 513 of the core plate 51 are in contact with each other, and the outer projecting part 526 and the seal wall part 542 are in contact with each other. By providing this outer projecting part 526, movement of the packing 53 outward of the tank is restricted.

In the present embodiment, by plastically-deforming a part of the fixation wall part 516 to be pressed on the tank main body part 52 with the packing 53 clamped between the seal wall part 542 of the tank fixation plate 54 and the skirt part 521 of the tank main body part 52, the tank main body part 52 is fixed to the tank fixation plate 54.

As described above, in the present embodiment, the skirt part 521 of the tank main body part 52 and the packing 53 are arranged at the first wall part 513 of the core plate 51 via the tank fixation plate 54. Thus, the surface of the first wall part 513 of the present embodiment that is joined to the tank fixation plate 54 corresponds to a "receiving part" in CLAIMS.

In the present embodiment, the surface of the first wall part 513 that is joined to the tank fixation plate 54 is located on a farther side from the tube 2 than a longitudinal end 20 of the tube in the tube longitudinal direction. Furthermore, a joint surface to the tank fixation plate 54 is provided on the tank-inward surface of the first wall part 513. Accordingly, the length of the core plate 51 in the air flow direction can be shortened, thereby producing effects similar to the above-described fifth embodiment.

Seventh Embodiment

A seventh embodiment will be described with reference to FIG. 9. This seventh embodiment is different from the above fifth embodiment in shapes of the core plate 51 and the tank fixation plate 54.

Figure 9:
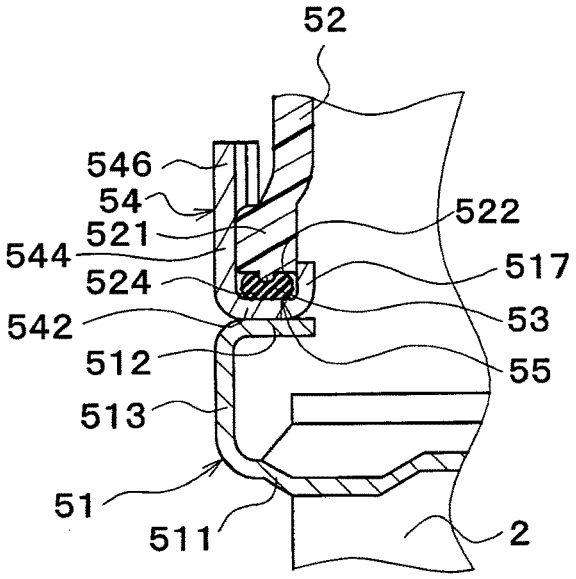
FIG. 9 is a cross-sectional view illustrating a header tank of a radiator in accordance with a seventh embodiment.

As illustrated in FIG. 9, a core plate 51 of the present embodiment includes a third wall part 517 that is bent generally perpendicularly from an inner peripheral portion of a receiving part 512 toward a far side from a core part 4 to extend in the tube longitudinal direction. A tank fixation plate 54 of the present embodiment does not have the inner wall part 543.

Accordingly, in the present embodiment, a groove portion 55, in which a skirt part 521 of a tank main body part 52 and a packing 53 are inserted, is formed by three surfaces: a wall surface of the third wall part 517 of the core plate 51, a wall surface of a seal wall part 542 of the tank fixation plate 54, and a wall surface of an outer wall part 544. In the present embodiment, effects similar to the above-described fifth embodiment can be produced.

Eighth Embodiment

An eighth embodiment will be described in reference to FIG. 10. This eighth embodiment is different from the above sixth embodiment in shapes of the tank main body part 52 and the tank fixation plate 54.

Figure 10:
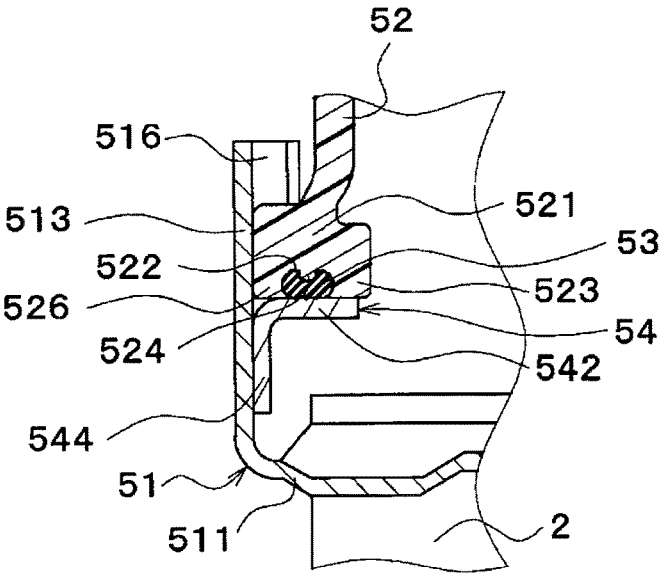
FIG. 10 is a cross-sectional view illustrating a header tank of a radiator in accordance with an eighth embodiment.

As illustrated in FIG. 10, a tank fixation plate 54 of the present embodiment does not have the inner wall part 543. An inner projecting part 523 that projects toward a seal wall part 542 of the tank fixation plate 54 is formed on an inner peripheral side of a tank-side sealing surface 522. By providing this inner projecting part 523, displacement of a packing 53 toward the inside of the tank is limited. In the present embodiment, effects similar to the above-described sixth embodiment can be produced.

Ninth Embodiment

A ninth embodiment will be described in reference to FIG. 11. This ninth embodiment is different from the above third embodiment in that the snap-fit part 525 is provided outside of the tank.

Figure 11:
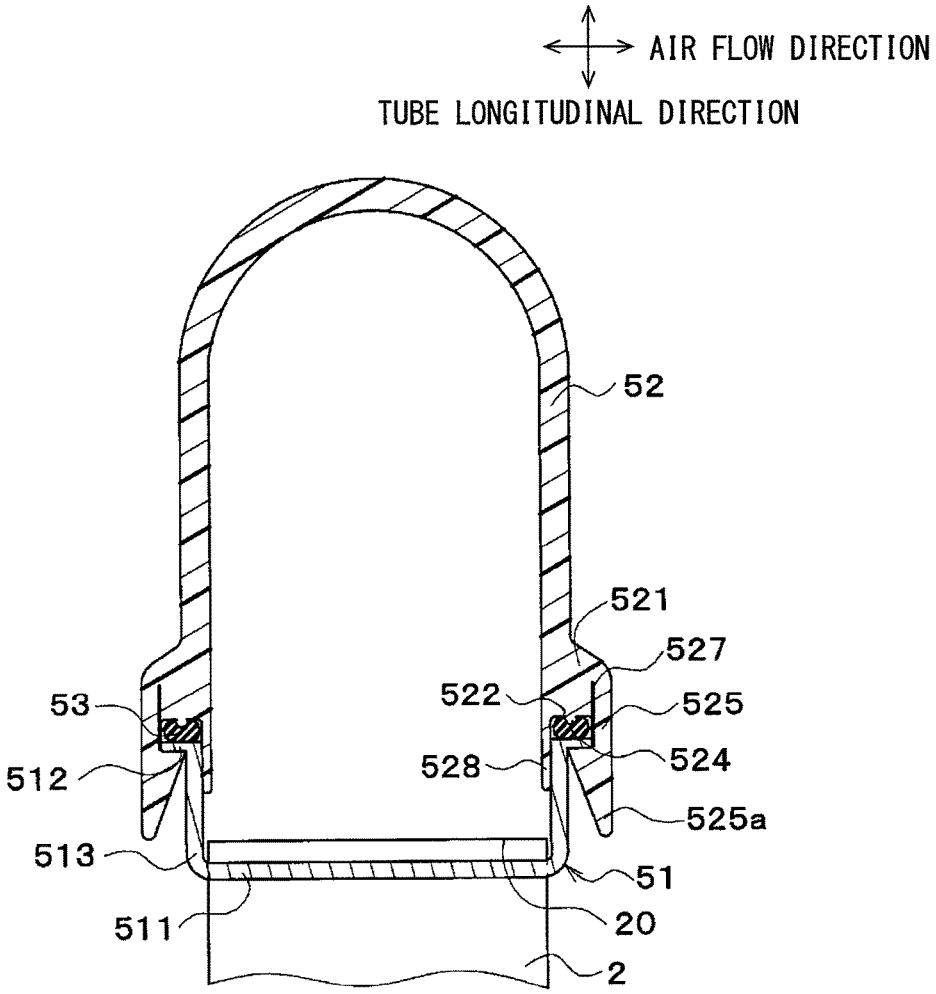
FIG. 11 is a cross-sectional view illustrating a header tank of a radiator in accordance with a ninth embodiment.

As illustrated in FIG. 11, a receiving part 512 of the present embodiment is bent generally perpendicularly from a wall part 513 of a core plate 51 outward of the tank to extend in a direction perpendicular to the tube longitudinal direction.

A snap-fit part 525 of the present embodiment is provided outward of a tank-side sealing surface 522. When attaching a tank main body part 52 to the core plate 51 from a far side from a tube 2 in the tube longitudinal direction, a pawl part 525*a* is brought into contact with an outer peripheral edge portion of the receiving part 512. Accordingly, by its resilient deformation, the snap-fit part 525 is bent outward of the tank with its connecting portion to the tank-side sealing surface 522 serving as a supporting point. Then, after the pawl part 525*a* has been displaced to a position closer to the tube 2 than the receiving part 512 in the tube longitudinal direction, when the snap-fit part 525 recovers its original shape, the snap-fit part 525 can be put into such a non-clearance state that a surface of the pawl part 525*a* on a far side from the tube 2 in the tube longitudinal direction is generally in contact with a surface of the receiving part 512 on a closer side to the tube 2 in the tube longitudinal direction.

An inner projecting part 528 projecting toward a close side to the tube 2 in the tube longitudinal direction is formed on an inner peripheral side of the tank-side sealing surface 522 (on a tank inward side). In the present embodiment, the inner projecting part 528 and the wall part 513 of the core plate 51 are in contact with each other. By providing this inner projecting part 528, displacement of a packing 53 toward the inside of the tank is limited. In the present embodiment, effects similar to the above-described third embodiment can be produced.

Tenth Embodiment

A tenth embodiment will be described with reference to FIG. 12. This tenth embodiment is different from the above third embodiment in that the snap-fit part is provided both inside of the tank and outside of the tank.

Figure 12:
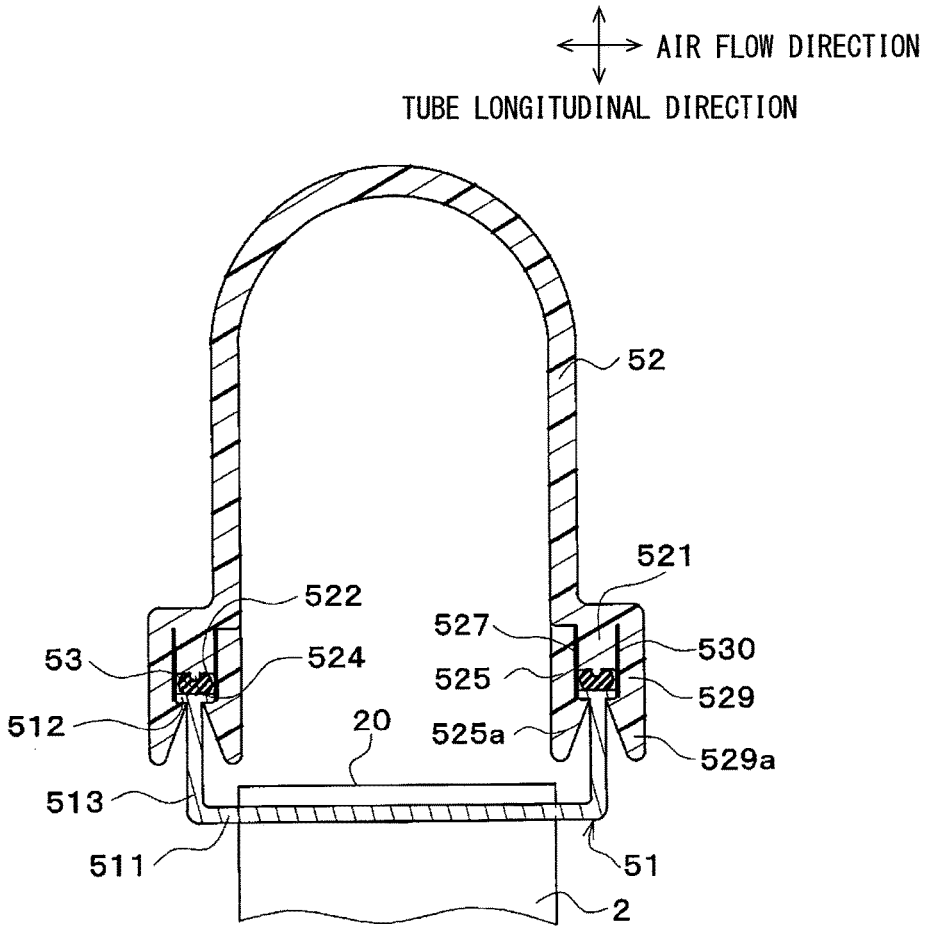
FIG. 12 is a cross-sectional view illustrating a header tank of a radiator in accordance with a tenth embodiment.

As illustrated in FIG. 12, a receiving part 512 of the present embodiment is connected to a wall part 513 of a core plate 51, and extends in a direction perpendicular to the tube longitudinal direction. The receiving part 512 projects from the wall part 513 both into the inside of the tank and into the outside of the tank.

In the present embodiment, snap-fit parts 525, 529 are provided both on an outer peripheral side and on an inner peripheral side of a tank-side sealing surface 522. The snap-fit part provided on the inner peripheral side of the tank-side sealing surface 522 is hereinafter referred to as an inner snap-fit part 525, and the snap-fit part provided on the outer peripheral side of the tank-side sealing surface 522 is hereinafter referred to as an outer snap-fit part 529.

The structure of the inner snap-fit part 525 is similar to the snap-fit part 525 of the third embodiment, and thus its explanation will be omitted. The outer snap-fit part 529 functions as a pawl-shaped engagement part. By attaching a tank main body part 52 to the core plate 51 from a far side from a tube 2 in the tube longitudinal direction, a pawl part 529*a* formed at the end of the outer snap-fit part 529 is engaged with the receiving part 512.

When attaching the tank main body part 52 to the core plate 51 from a far side from the tube 2 in the tube longitudinal direction, a pawl part 525*a* of the inner snap-fit part 525 is brought into contact with an inner peripheral edge portion of the receiving part 512. Accordingly, by its resilient deformation, the inner snap-fit part 525 is bent inward of the tank with its connecting portion to the tank-side sealing surface 522 serving as a supporting point. In this case, at the same time, the pawl part 529*a* of the outer snap-fit part 529 is brought into contact with an outer peripheral edge portion of the receiving part 512. Consequently, by its resilient deformation, the outer snap-fit part 529 is bent outward of the tank with its connecting portion to the tank-side sealing surface 522 serving as a supporting point.

Then, after the pawl parts 525*a*, 529*a* have been displaced to positions closer to the tube 2 than the receiving part 512 in the tube longitudinal direction, when the snap-fit parts 525, 529 recover their original shapes, the snap-fit parts 525, 529 can be put into such a non-clearance state that surfaces of the pawl parts 525*a*, 529*a* on a far side from the tube 2 in the tube longitudinal direction are generally in contact with a surface of the receiving part 512 on a closer side to the tube 2 in the tube longitudinal direction.

A skirt part 521 includes an inner slit 527 that extends from a connecting portion to the inner snap-fit part 525 toward a far side from the tube 2 in the tube longitudinal direction, and an outer slit 530 that extends from a connecting portion to the outer snap-fit part 529 toward a far side from the tube 2 in the tube longitudinal direction. The snap-fit parts 525, 529 are easily resiliently-deformed by these slits 527, 530. Accordingly, the tank main body part 52 can easily be attached to the core plate 51.

In the present embodiment, the snap-fit parts 525, 529 are provided both inside of the tank and outside of the tank. As a result, the tank main body part 52 can be more reliably fixed to the core plate 51.

Modifications to the above embodiments will be described. The present disclosure is not limited to the above-described embodiments, and can be modified in various manners as below without departing from the scope of the present disclosure. The means disclosed in the above embodiments may be combined together appropriately within their practicable limits.

(1) In the above first embodiment, it has been illustrated that the inner projecting part 523 of the tank main body part 52 and the inner peripheral end portion of the receiving part 512 of the core plate 51 are in contact with each other. Alternatively, the inner projecting part 523 and a surface of the receiving part 512 on a far side from the core part 4 may be in contact with each other.

(2) In the above embodiments, the example of application of the heat exchanger of the present disclosure to the radiator 1 has been explained. However, the present disclosure can also be applied to another heat exchanger such as an evaporator or a refrigerant radiator (refrigerant condenser).

Figure 13:
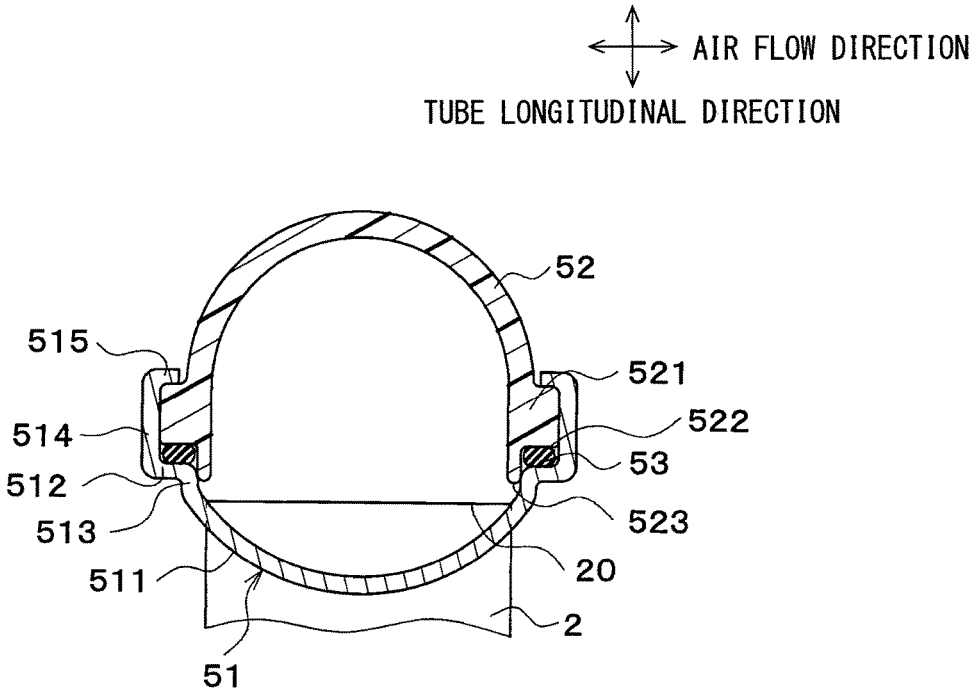
FIG. 13 is a cross-sectional view illustrating a modification to the tank main body part.

(3) As illustrated in FIG. 13, the tank main body part 52 does not need to include the projection 524.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A heat exchanger comprising:

a plurality of tubes which are arranged in parallel with each other and through which fluid flows in a longitudinal direction of the plurality of tubes; and a header tank that is disposed at end portions of the plurality of tubes, the header tank extending in a direction perpendicular to the longitudinal direction of the plurality of tubes in which the plurality of tubes are arranged in parallel with each other to communicate with the plurality of tubes, wherein:

the header tank includes:

a core plate to which the plurality of tubes are joined;

a resin tank main body part that is fixed to the core plate; and a resiliently-deformable sealing member;

the core plate includes a receiving part at which the sealing member is disposed;

the tank main body part is fixed to the core plate with the sealing member clamped between an end part of the tank main body part on the core plate side and the receiving part;

the receiving part is disposed on a farther side from the plurality of tubes in the longitudinal direction of the plurality of tubes than the end portions of the plurality of tubes in the longitudinal direction of the plurality of tubes;

the end part of the tank main body part includes a tank-side sealing surface on the core plate side; and a vertical gap is defined between the tank-side sealing surface and each of the end portions of the plurality of tubes, wherein the sealing member is resiliently compressed between the end part of the tank main body part and the receiving part of the core plate in the longitudinal direction of the plurality of tubes when the tank main body part is fixed to the core plate, the core plate includes a pawl that is bent from an outer peripheral side of the receiving part toward the end part to fix the tank main body part, the end part includes a projecting part that projects toward the end portions of the plurality of tubes in the longitudinal direction of the plurality of tubes and limits displacement of the sealing member toward an inner peripheral side of the header tank, the receiving part has a flat plate shape extending in a direction perpendicular to the longitudinal direction of the plurality of tubes, the core plate includes a wall part connecting together the pawl and the receiving part, and the sealing member is accommodated in a space surrounded by the wall part, the receiving part, the tank-side sealing surface and the projecting part, thereby enclosing the sealing member.

2. The heat exchanger according to claim 1, wherein the end part includes:

a snap-fit part that projects toward the end portions of the plurality of tubes in the longitudinal direction of the plurality of tubes and has a pawl part in engagement with an inner peripheral edge part of the receiving part, at an end portion of the snap-fit part; and a projecting part that projects toward the end portions of the plurality of tubes in the longitudinal direction of the plurality of tubes and limits displacement of the sealing member toward an outer peripheral side of the header tank.

3. The heat exchanger according to claim 1, wherein the resin tank main body part is spaced away from the end portions of the plurality of tubes in the longitudinal direction of the plurality of tubes.

4. The heat exchanger according to claim 1, wherein the receiving part is disposed further into the header tank in the longitudinal direction of the plurality of tubes than the end portions of the plurality of tubes in the longitudinal direction of the tubes.

5. A heat exchanger comprising:

a plurality of tubes which are arranged in parallel with each other and through which fluid flows in a longitudinal direction of the plurality of tubes; and a header tank that is disposed at end portions of the plurality of tubes, the header tank extending in a direction perpendicular to the longitudinal direction of the plurality of tubes in which the plurality of tubes are arranged in parallel with each other to communicate with the plurality of tubes, wherein:

the header tank includes:

a core plate to which the plurality of tubes are joined;

a resin tank main body part that is fixed to the core plate; and a resiliently-deformable sealing member;

the core plate includes a receiving part at which the sealing member is disposed;

the tank main body part is fixed to the core plate with the sealing member clamped between an end part of the tank main body part on the core plate side and the receiving part;

a distance in the longitudinal direction of the plurality of tubes from where the core plate is joined to the plurality of tubes to the receiving part is greater than a distance in the longitudinal direction of the tubes from where the core plate is joined to the plurality of tubes to terminal ends of the plurality of tubes;

the end part of the tank main body part includes a tank-side sealing surface on the core plate side; and a vertical gap is defined between the tank-side sealing surface and each of the end portions of the plurality of tubes, wherein the sealing member is resiliently compressed between the end part of the tank main body part and the receiving part of the core plate in the longitudinal direction of the plurality of tubes when the tank main body part is fixed to the core plate, the core plate includes a pawl that is bent from an outer peripheral side of the receiving part toward the end part to fix the tank main body part, the end part includes a projecting part that projects toward the end portions of the plurality of tubes in the longitudinal direction of the plurality of tubes and limits displacement of the sealing member toward an inner peripheral side of the header tank, the receiving part has a flat plate shape extending in a direction perpendicular to the longitudinal direction of the plurality of tubes, the core plate includes a wall part connecting together the pawl and the receiving part, and the sealing member is accommodated in a space surrounded by the wall part, the receiving part, the tank-side sealing surface and the projecting part, thereby enclosing the sealing member.

6. The heat exchanger according to claim 1, wherein a portion of the tank main body part is inset of the core plate.

7. The heat exchanger according to claim 1, wherein in the longitudinal direction of the plurality of tubes, the sealing member is clamped between the tank main body part and the core plate, and is in contact with two surfaces of the tank main body part and two surfaces of the core plate.

8. A heat exchanger comprising:

a plurality of tubes which are arranged in parallel with each other and through which fluid flows in a longitudinal direction of the plurality of tubes; and a header tank that is disposed at end portions of the plurality of tubes, the header tank extending in a direction perpendicular to the longitudinal direction of the plurality of tubes in which the plurality of tubes are arranged in parallel with each other to communicate with the plurality of tubes, wherein:

the header tank includes:

a core plate to which the plurality of tubes are joined;

a resin tank main body part that is fixed to the core plate; and a resiliently-deformable sealing member;

the core plate includes a receiving part at which the sealing member is disposed;

the tank main body part is fixed to the core plate with the sealing member clamped between an end part of the tank main body part on the core plate side and the receiving part;

the receiving part is disposed on a farther side from the plurality of tubes in the longitudinal direction of the plurality of tubes than the end portions of the plurality of tubes in the longitudinal direction of the plurality of tubes;

the end part of the tank main body part includes a tank-side sealing surface on the core plate side; and a vertical gap is defined between the tank-side sealing surface and each of the end portions of the plurality of tubes, wherein the sealing member is resiliently compressed between the end part of the tank main body part and the receiving part of the core plate in the longitudinal direction of the plurality of tubes when the tank main body part is fixed to the core plate, the core plate includes a pawl that is bent from an outer peripheral side of the receiving part toward the end part to fix the tank main body part, the end part includes a projecting part that projects toward the end portions of the plurality of tubes in the longitudinal direction of the plurality of tubes, extending past and in contact with the receiving part, and limits displacement of the sealing member toward an inner peripheral side of the header tank, the receiving part has a flat plate shape extending in a direction perpendicular to the longitudinal direction of the plurality of tubes, the core plate includes a wall part connecting together the pawl and the receiving part, and the sealing member is accommodated in a space surrounded by the wall part, the receiving part, the tank-side sealing surface and the projecting part.

* * * * *